US011428079B2

(12) United States Patent
Yeh et al.

(10) Patent No.: US 11,428,079 B2
(45) Date of Patent: Aug. 30, 2022

(54) MATERIAL CONTROL TO PREVENT WELL PLUGGING

(71) Applicant: ExxonMobil Upstream Research Company, Spring, TX (US)

(72) Inventors: Charles S. Yeh, Spring, TX (US); Timothy K. Ellison, Houston, TX (US); Tracy J. Moffett, Sugar Land, TX (US); Michael D. Barry, The Woodlands, TX (US); Andy J. Veselka, Houston, TX (US); Elizabeth L. Templeton-Barrett, Houston, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 16/855,513

(22) Filed: Apr. 22, 2020

(65) Prior Publication Data

US 2020/0378219 A1 Dec. 3, 2020

Related U.S. Application Data

(60) Provisional application No. 62/853,917, filed on May 29, 2019.

(51) Int. Cl.
*E21B 43/08* (2006.01)

(52) U.S. Cl.
CPC ..... *E21B 43/082* (2013.01)

(58) Field of Classification Search
CPC ..... E21B 43/08; E21B 43/082; E21B 43/084; E21B 43/086; E21B 43/088
See application file for complete search history.

(56) References Cited

U.S. PATENT DOCUMENTS

| | | | | |
|---|---|---|---|---|
| 975,334 | A | 11/1910 | Decker et al. | |
| 3,280,915 | A | 10/1966 | De Witt et al. | |
| 3,709,293 | A | 1/1973 | Layne, II et al. | |
| 4,421,646 | A | 12/1983 | Correge et al. | |
| 5,004,049 | A | 4/1991 | Arterbury | |
| 5,551,513 | A * | 9/1996 | Surles | B01D 39/2075 166/205 |
| 6,745,843 | B2 | 6/2004 | Johnson et al. | |

(Continued)

FOREIGN PATENT DOCUMENTS

| | | |
|---|---|---|
| CN | 105257250 | 1/2016 |
| JP | 2007126686 | 5/2007 |

(Continued)

OTHER PUBLICATIONS

Kenneth E. Hill, "Factors Affecting The Use of Gravel In Oil Wells", Drilling And Production Practice, 1941, pp. 132-143, American Petroleum Institute, New York, N.Y.

*Primary Examiner* — David Carroll
(74) *Attorney, Agent, or Firm* — ExxonMobil Upstream Research Company—Law Department

(57) ABSTRACT

A method and systems for sand control in wells are described in examples. An example uses a prepack screen assembly comprising an inner screen comprising openings having an inner size and an outer screen comprising openings having an outer size. Packing material is disposed between the inner screen and the outer screen comprising pores with a pore size that is selected based, at least in part, on the outer size, the inner size, or both.

34 Claims, 10 Drawing Sheets

700

(56) References Cited

U.S. PATENT DOCUMENTS

| | | | | |
|---|---|---|---|---|
| 7,464,752 | B2 | 12/2008 | Dale et al. | |
| 7,849,925 | B2 | 12/2010 | Patel | |
| 8,783,349 | B2 | 7/2014 | Robisson et al. | |
| 9,587,474 | B2 | 3/2017 | Entchev et al. | |
| 9,695,675 | B2 | 7/2017 | Hall | |
| 1,256,830 | A1 | 2/2019 | Rodrigo | |
| 2008/0035330 | A1 | 2/2008 | Richards | |
| 2008/0289815 | A1 | 11/2008 | Moen et al. | |
| 2010/0051262 | A1* | 3/2010 | Dusterhoft | E21B 47/01 166/236 |
| 2012/0067587 | A1 | 3/2012 | Agrawal et al. | |
| 2012/0211223 | A1 | 8/2012 | Guest et al. | |
| 2013/0081800 | A1 | 4/2013 | Riisem et al. | |
| 2014/0027108 | A1 | 1/2014 | Lopez et al. | |
| 2015/0068760 | A1* | 3/2015 | Johnson | E21B 43/082 166/369 |
| 2016/0258256 | A1* | 9/2016 | Nguyen | B22F 3/10 |
| 2017/0044880 | A1* | 2/2017 | Yeh | E21B 43/12 |
| 2017/0122081 | A1 | 5/2017 | Gallo et al. | |
| 2017/0211361 | A1 | 7/2017 | Reid et al. | |
| 2018/0030812 | A1 | 2/2018 | Ning et al. | |

FOREIGN PATENT DOCUMENTS

| | | | |
|---|---|---|---|
| WO | 2010143060 | A1 | 12/2010 |
| WO | 2020005382 | A1 | 1/2020 |

* cited by examiner

100

PRIOR ART

200

300

400

500

600

700

800

1000

MATERIAL CONTROL TO PREVENT WELL PLUGGING

CROSS-REFERENCE TO RELATED APPLICATION

This application claims the benefit of U.S. Provisional Application 62/853,917 filed May 29, 2019 entitled MATERIAL CONTROL TO PREVENT WELL PLUGGING, the entirety of which is incorporated by reference herein.

FIELD

The present techniques relate to the use of injection of fluids in hydrocarbon production. Specifically, techniques are disclosed for using prepacked screens to prevent plugging of injection wells.

BACKGROUND

This section is intended to introduce various aspects of the art, which may be associated with exemplary embodiments of the present techniques. This discussion is believed to assist in providing a framework to facilitate a better understanding of particular aspects of the present techniques. Accordingly, it should be understood that this section should be read in this light, and not necessarily as admissions of prior art.

Modern society is greatly dependent on the use of hydrocarbons for fuels and chemical feedstocks. Hydrocarbons are generally found in subsurface rock formations that can be termed "reservoirs." Removing hydrocarbons from the reservoirs depends on numerous physical properties of the rock formations, such as the permeability of the rock containing the hydrocarbons, the ability of the hydrocarbons to flow through the rock formations, and the proportion of hydrocarbons present, among others.

Easily produced sources of hydrocarbon are dwindling, leaving less accessible sources to satisfy future energy needs. However, as the costs of hydrocarbons increase, these less accessible sources become more economically attractive.

Injection of fluids, such as water or gas, has been used in the oil and gas field to maintain reservoir pressure, accelerate production, and increase reserve recovery. In weakly consolidated reservoirs, downhole sand control is required in injection wells. Common methods to control sand production include standalone screens, cased-hole or open-hole gravel packs, and frac packs. Their performance has been mixed, particularly in long-term reliability. Well fills causing injection disruption may occur. Any reduced or delayed water injection would adversely affect the hydrocarbon production.

Wire-wrap screen or mesh screens are common standalone screens for injection sand control. Plugging and erosion have been two major causes in downhole sand control failures. Screen plugging could result from poor injection water quality and formation sand carried by the water hammer effect or the cross flow during shut-ins. Screen erosion could develop from high local outflow due to progressive plugging or non-uniform formation collapse in the wellbore annulus. The eroded screen allows formation sand into the screen basepipe during either planned or unplanned shut-ins. The settling of formation sand inside the screen eventually blocks the entire completion interval and ceases the injection.

A conventional prepack screen includes a gravel pack or a resin-coated gravel pack placed between two concentric sand barriers (e.g., screens) to better control sand than a screen alone (U.S. Pat. No. 1,256,830 (1918), API-41-134 (1941), U.S. Pat. No. 3,280,915 (1966), U.S. Pat. No. 4,421,646 (1983), U.S. Pat. No. 5,004,049 (1991), U.S. Pat. No. 5,551,513 (1996)). Historically, plugging has been encountered in the prepack screens either during installation or production. Nowadays, prepack screens are only considered across clean, coarse, well-sorted, and homogeneous sands in high-angle wells. Commercial prepack screens are available, and include but not limited to Dual-Screen Prepack Screen, DeltaPak™, Micro-PAK®, WeldSlot PP, and SLIM-PAK™.

Gravel pack or frac pack has been effective in the matrix injection for sand control. However, as the injection went beyond fracture pressure, which is not uncommon to obtain the desired injectivity, loss of the annular gravel pack into the fractures results in a partial standalone screen completion and the accompanied erosion potential.

Resin-coated sand/proppant and fiber network were developed to reinforce gravel pack to prevent gravel loss. They often require downhole temperature or stress to cure over time up to a certain compressive strength, although few products cured using activators do not need stress. They also may require on-site chemical fly and monitoring to activate resin consolidation. The return chemicals and resin-coated sand must have properly disposal procedures. These multifaceted factors add complexity to both design and operations in gravel pack or frac pack. Any local resin-coated sand pack with insufficient strength may fail to fulfill the intent of preventing gravel loss.

SUMMARY

An embodiment described herein provides a system for sand control for a well. The system includes a well drilled through the reservoir, or in the well includes a pipe joint including a prepack screen assembly mounted thereon. The prepack screen assembly includes an inner screen including openings having an inner size, and outer screen including openings having an outer size. Packing material is disposed between the inner screen and the outer screen. The packing material includes pores having a pore size that is selected based, at least in part, on the outer size, the inner size, or both.

Another embodiment described herein provides a method for designing a prepack screen assembly for sand control. The method includes analyzing a type of well in which the prepack screen assembly is going to be used. A screen design and screen sizes for the prepack assembly are selected, wherein the screens include an inner screen with openings having an inner size, and an outer screen with openings having an outer size. Packing for the prepack screen assembly is designed, wherein the packing includes pores comprising a pore size that is selected based, at least in part, on the outer size, the inner size, or both. The prepack screen assembly is placed on a pipe joint, and the pipe joint is placed in a well.

Another embodiment described herein provides a prepack screen assembly. The prepack screen assembly includes an inner screen including openings having an inner size and an outer screen including openings having an outer size. Packing material is disposed between the inner screen and the outer screen. The packing material includes pores with a pore size that is selected, based at least in part, on the outer size, the inner size, or both.

DESCRIPTION OF THE DRAWINGS

The advantages of the present techniques are better understood by referring to the following detailed description and the attached drawings, in which.

DETAILED DESCRIPTION

Figure 1:
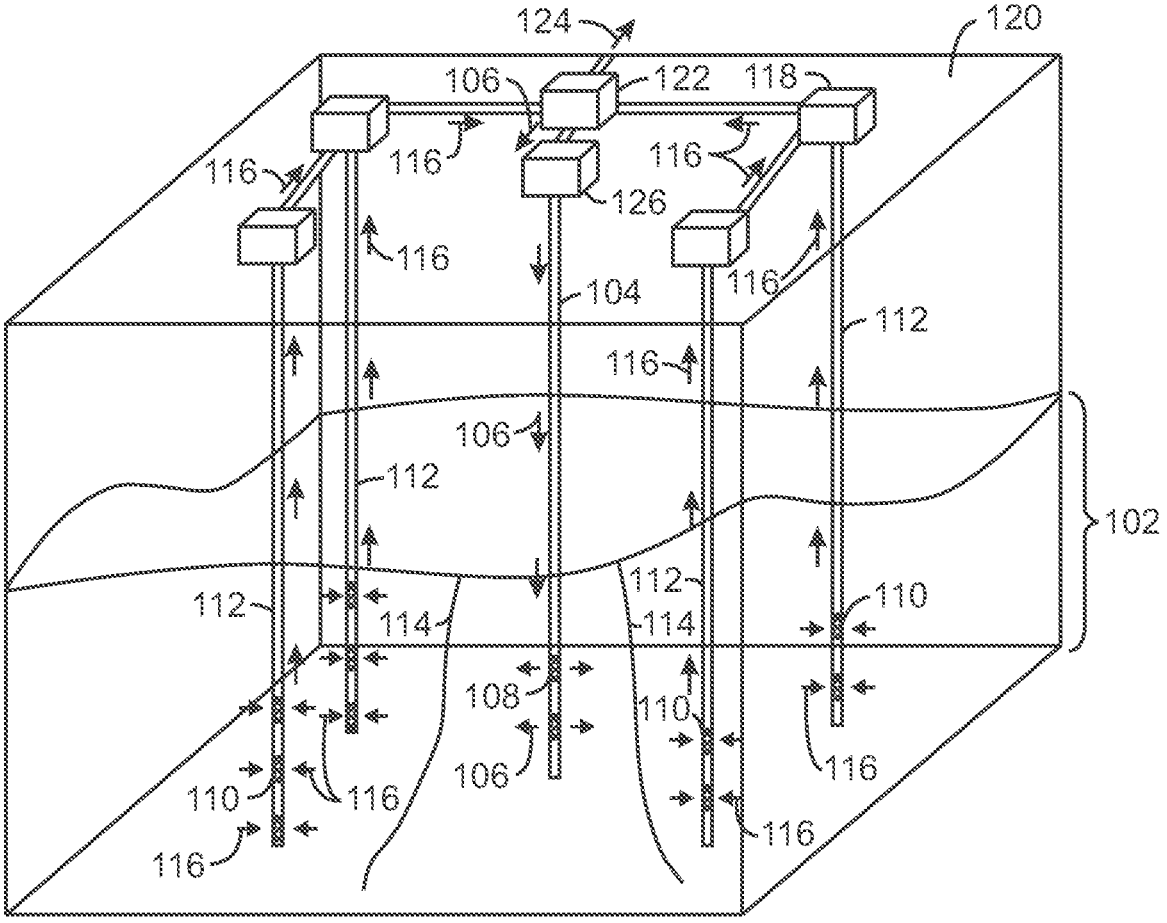
FIG. 1 is a drawing of a water injection process used for producing hydrocarbons from a reservoir, in accordance with examples.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, two locations in a reservoir are in "fluid communication" when a path for fluid flow exists between the locations. For example, the establishment of fluid communication between an injection well and a production well may force hydrocarbons through a reservoir towards the production well for collection and production as water or gas is injected into the reservoir through injection well. As used herein, a fluid includes a gas or a liquid and may include, for example, a produced hydrocarbon, an injected mobilizing fluid, such as gas or water, among other materials.

"Facility" as used in this description is a tangible piece of physical equipment through which hydrocarbons and other fluids are either produced from a reservoir or injected into a reservoir, or equipment which can be used to control production or completion operations. In its broadest sense, the term facility is applied to any equipment that may be present along the flow path between a reservoir and its delivery outlets. Facilities may comprise production wells, injection wells, well tubulars, wellhead equipment, gathering lines, manifolds, pumps, compressors, separators, surface flow lines, steam generation plants, processing plants, and delivery outlets. In some instances, the term "surface facility" is used to distinguish those facilities other than wells.

A "hydrocarbon" is an organic compound that primarily includes the elements hydrogen and carbon, although nitrogen, sulfur, oxygen, metals, or any number of other elements may be present in small amounts. As used herein, hydrocarbons generally refer to components found in oil, natural gas, or other types of organic compounds found in hydrocarbon reservoirs.

"Pressure" is the force exerted per unit area by a fluid, such as water, gas, or hydrocarbons, on the walls of the volume measured. Pressure can be shown as pounds per square inch (psi). "Atmospheric pressure" refers to the local pressure of the air. "Absolute pressure" (psia) refers to the sum of the atmospheric pressure (14.7 psia at standard conditions) plus the gauge pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia). The term "vapor pressure" has the usual thermodynamic meaning. For a pure component in an enclosed system at a given pressure, the component vapor pressure is essentially equal to the total pressure in the system.

As used herein, a "reservoir" is a subsurface rock or sand formation from which a production fluid, or resource, can be harvested. The rock formation may include sand, granite, silica, carbonates, clays, and organic matter, such as bitumen, heavy oil, oil, gas, or coal, among others. Reservoirs can vary in thickness from less than one foot (0.3048 m) to hundreds of feet (hundreds of m). The resource is generally a hydrocarbon, such as a heavy oil impregnated into a sand bed.

"Substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context.

A "wellbore" is a hole in the subsurface made by drilling or inserting a conduit into the subsurface. A wellbore may have a substantially circular cross section or any other cross-sectional shape, such as an oval, a square, a rectangle, a triangle, or other regular or irregular shapes. As used herein, the term "well," when referring to an opening in the formation, may be used interchangeably with the term "wellbore."

Revised designs for prepack screens to improve sand control in injection wells are described in examples herein. As used herein, an injection well includes wells used for injecting fluids, such as water or gas, for example, for enhanced recovery of hydrocarbons from reservoirs. Other types of injection wells may also use the designs described herein, such as injection wells used for sequestration of carbon dioxide, and saltwater disposal wells, among others. More specifically, the proposed prepack screens address the potential for well fills by formation material, such as sand. When injection wells are shut in, material from the formation may be drawn into the well from pressure changes, plugging the well.

Although the designs described are generally focused towards injection wells, they may be used in production wells as well. Further, in some examples, the designs are used in wells that may be used as injection wells or production wells at different points in time. Further, the designs may be used with any number of completion options, including, for example, a standalone screen, a gravel pack or frac pack, a shunted zonal isolation packer, a shunted zonal eccentric packer, an inflow control device or inflow control valve, a zonal isolation completion, a maze flow completion or a self-mitigating screen similar to the disclosures in U.S. Pat. No. 7,464,752, a multiple compartments completion, or a hybrid completion similar to the disclosures in US 2017/0044880. The type of well, injection, production, or alternating between injection and production, is considered in the design of the prepack screens.

The advance of emerging technology like zonal isolation, inflow control devices, shape memory materials, and three-dimensional (3D) printing may further expand the opportunities. For example, the prepack screens may be used to form multiple prepack screen assemblies in compartments along a pipe joint. The use of a series of separate compartments, along with check valves installed in inlets on the basepipe, may prevent material contamination from damaging a prepack screen covering an entire joint. The check valves on the basepipe prevent majority flow in production direction during shut-ins of an injection well. Thus, if a hotspot, such as screen erosion and material infiltration into the prepack screen occurs, the incoming formation material may be trapped in the prepack screen of the separate compartment, preventing loss of water injection through the entire pipe joint.

FIG. 1 is a schematic drawing of a water injection process 100 used for producing hydrocarbons from a reservoir 102, in accordance with examples. In this example, an injection well 104 is used to inject water 106 into the reservoir 102. As discussed in further detail herein, prepack screens 108 are used improve sand control in the injection well 104. Further, in some examples, other prepack screens 110 may be used to improve sand control in the production wells 112. As shown in the water injection process 100, the prepack screens 108 or 110 may be divided into compartments, for example, of about 50 cm, 100 cm, or 200 cm in length. The compartments help to prevent plugging of multiple injection points, or prepack screens 108 or 110, should one of the prepack screens 108 or 110 fail. This prevents multiple points of failure, which protects from plugging flow into an injection well 104 or out of a production well 112 if one of the prepack screens 108 or 110 fails.

As the water 106 is injected into the reservoir 102, it may form a flow front 114 that forces hydrocarbons 116 towards the production wells 112, where it is brought to wellheads 118 or pumps, such as pump jacks, at the surface 120. Some of the water 106 from the injection is entrained with the hydrocarbons 116 as they are produced.

In this example, the hydrocarbons 116 are brought to a separation facility 122 at the surface 120. In the separation facility 122, the water 106 entrained with the hydrocarbons 116 may be separated from the hydrocarbons 116, resulting in a clean hydrocarbon stream 124 which may be sent through a pipeline, railcar, or truck for transport to a refining facility. The water 106 separated from the hydrocarbons 116 may then be returned to the injection well head 126 to be combined with other water sources, and reinjected into the injection well 104. In an example, the injection well head 126 is used for a disposal well, such as for wastewater from fracking operations.

Figure 2:
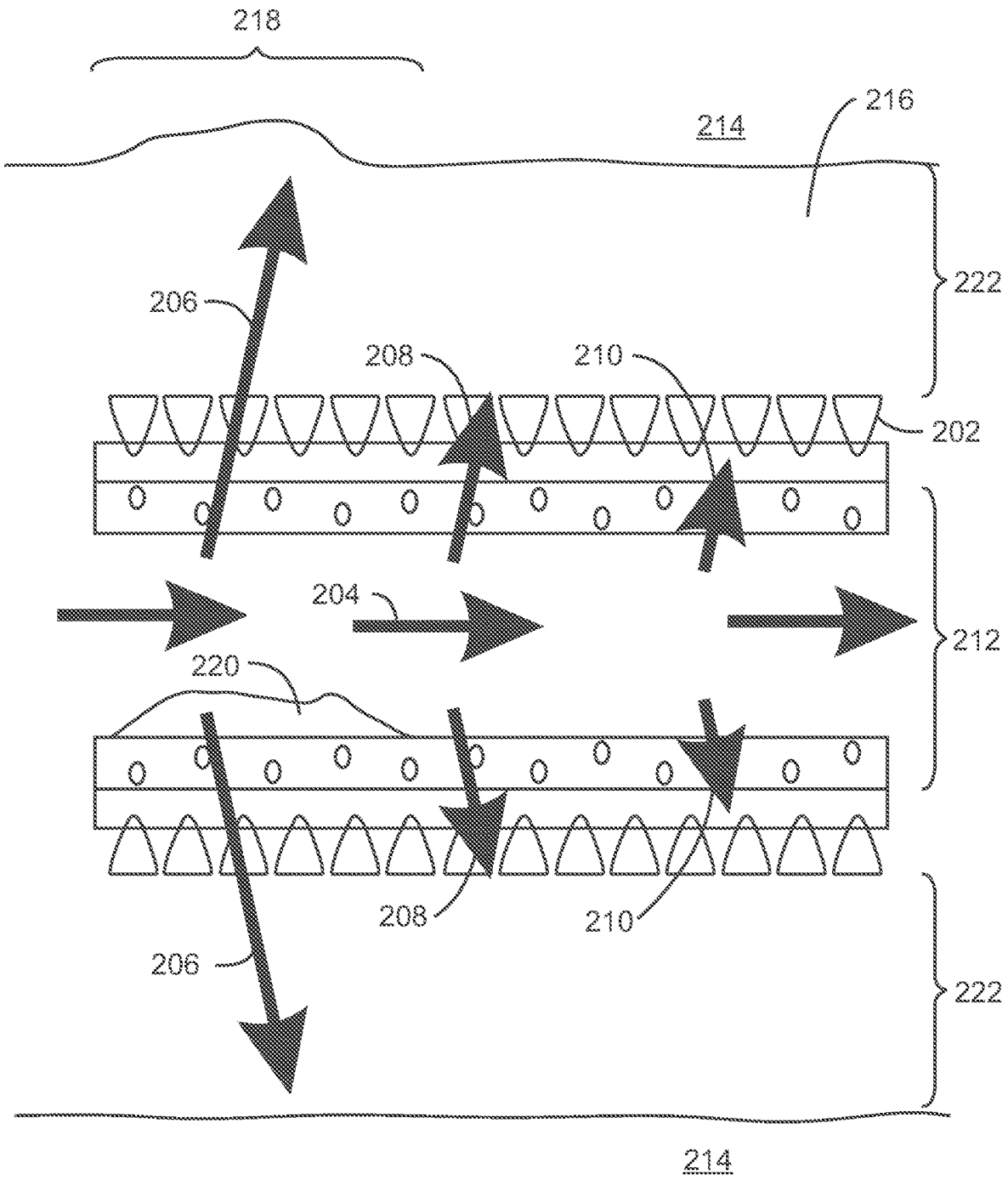
FIG. 2 is a drawing of an unpacked screen assembly, showing flow radially outward at the leading section of the screen.

FIG. 2 is a cross sectional view 200 of an unpacked screen assembly 202 in an injection well, showing an injection fluid 204 having a greatest flow 206 radially outward at the leading section of the unpacked screen assembly 202. Accordingly, as the injection fluid 204 flows further down the injection zone, the flow out is reduced as illustrated by arrows 208 and 210.

Injection wells have several significant differences from production wells. First, an injection well delivers an injection fluid 204 from surface via a single basepipe 212 to the completion interval 214. In a standalone screen completion with an unpacked annulus, for example, with an undamaged screen, the greatest flow 206 of the fluid entering the completion interval may be radially outward at the leading section of the screen into the wellbore annulus 216. The greatest flow 206, in this example, is due to a lower back pressure across the screen of the unpacked screen assembly 202 allowing higher flow in the early portion screen. The high flow velocity leads to high erosion potential for the wellbore annulus 216 in the leading section 218 of the unpacked screen assembly 202.

Further, an injection well is subject to periodic shut-ins. During a shut-in, a water hammer effect, cross flow, or both could shear fail the formation sand, or other solids, toward the surface of the unpacked screen assembly 202. Some sand will pass through the unpacked screen assembly 202 before the surface of unpacked screen assembly 202 is bridged off by the sand 220. The sand 220 that is accumulated inside the single basepipe 212 may not be cleaned out after the injection is resumed. Accordingly, the wellbore annulus 222 is expected to be, at least, partially open during injection and to be, at least, partially filled during shut-in due to cross flow. Further, this cycle is repeated during each shut-in, which may result in long-term damage or plugging of the unpacked screen assembly 202.

In this example, the openings of the unpacked screen assembly 202 are termed keystone slots, or openings, as the larger opening faces inward towards the basepipe 212, and the smaller opening faces outward towards the wellbore annulus 222. In other examples described herein, openings in screen assemblies may have a larger opening facing towards the wellbore annulus and a smaller opening facing towards a basepipe. This type of opening would be termed an inverse-keystone slot.

Figure 3:
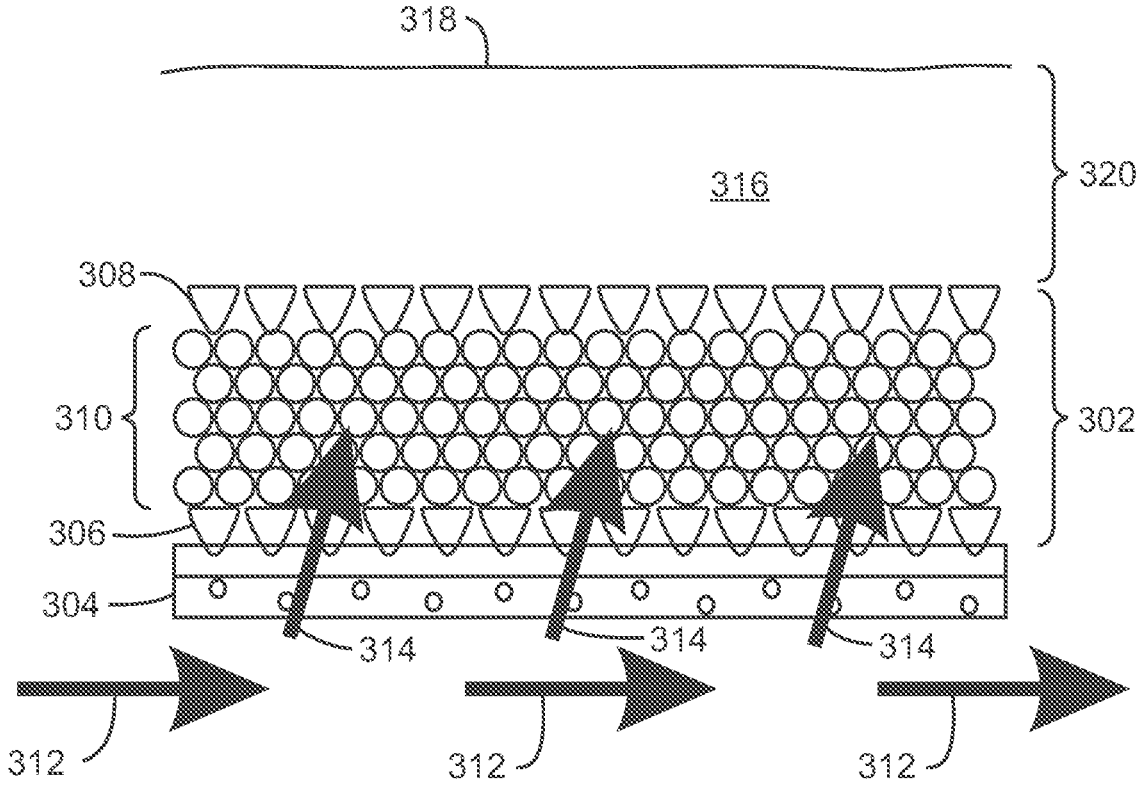
FIG. 3 is a drawing of prepack screen assembly, showing flow resistance in a prepack screen, in accordance with examples.

FIG. 3 is a cross sectional view 300 of one side of a prepack screen assembly 302 and a basepipe 304, showing improved flow resistance, in accordance with examples. The prepack screen assembly 302 has an inner screen 306 and outer screen 308, which are separated by packing material 310.

In this example, the resistance to flow in the prepack screen assembly 302 provides continuous outflow regulation of the injection fluid 312, leading to more evenly distributed outflow 314 of the injection fluid 312 along the prepack screen assembly 302 to the wellbore annulus 316 without compromising the flow into the well. A more uniform injection profile delays or avoids erosion of the prepack screen assembly 302 or the side 318 of the wellbore 320. The prepack screen assembly 302 can be combined with an inflow control device, which provides more equalized outflow between screen joints. The use of the inflow control device may also decrease the chances of a water hammer damaging the prepack screen assembly 302.

The prepack screen assembly 302 may also provide better sand retention during shut-in, due to improved suppression of water hammer and cross flow, than a single-barrier standalone screen. The three sand retention barriers, the inner screen 306, the outer screen 308, and the packing material 310, in the prepack screen assembly 302 provide a more flexible design and less sand production during each shut-in. In examples described herein, the inner screen 306, the outer screen 308 or both, may include a slip-on wire wrap screen, a direct-wrap wire wrap screen, a premium screen, a protective shroud, or any combinations thereof.

Accordingly, due to reduced erosion risk and better filtering, the prepack screen assembly 302 delays well fill by reducing formation sand into the basepipe during shut-ins, potentially leading to a longer life for the well. Due to reduced erosion risk and better filtering, prepack delays well fill by reducing formation sand into basepipe during shut-ins.

Figure 4:
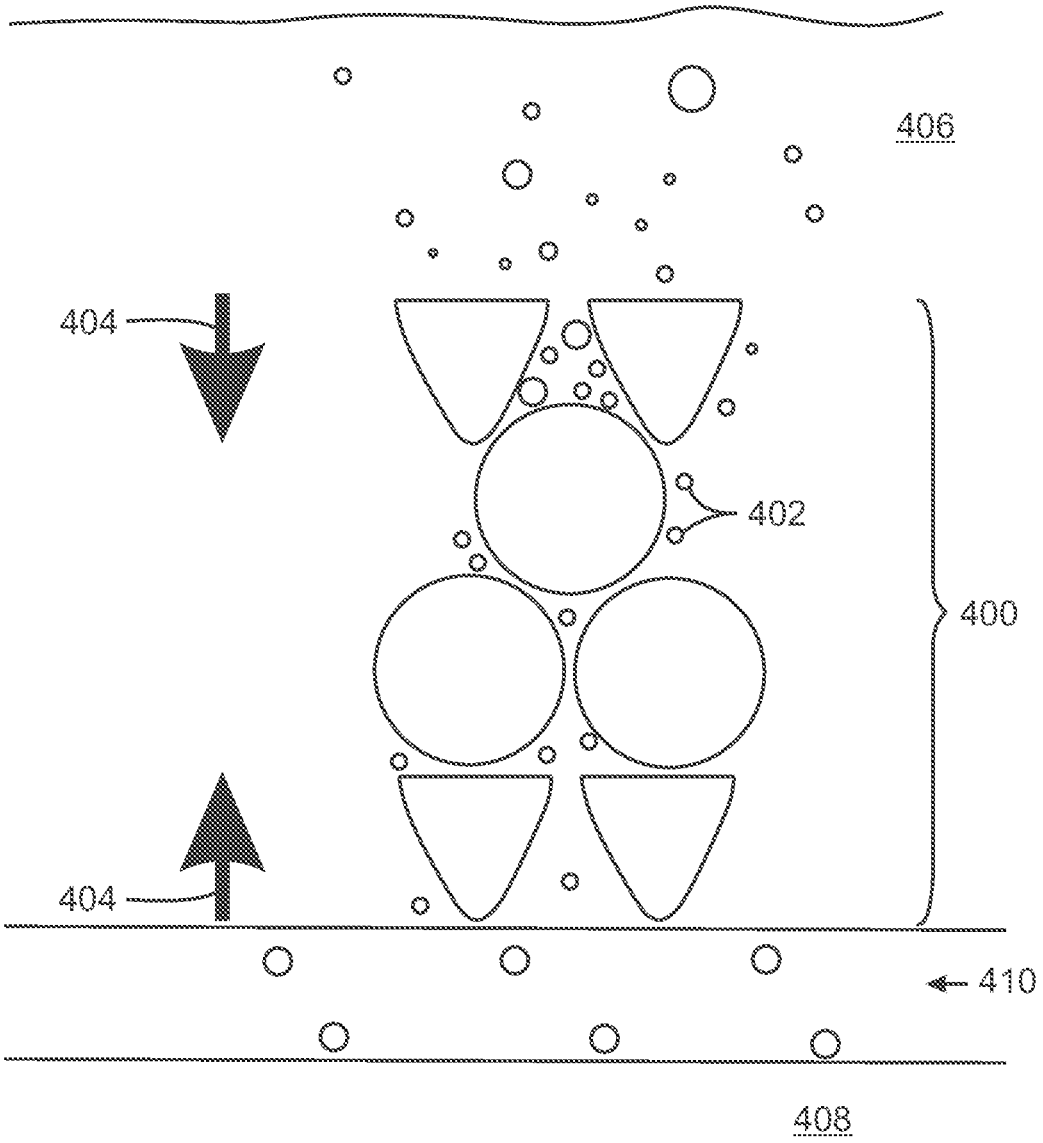
FIG. 4 is a schematic diagram of a prepack design, showing fines passing through the prepack screen during cross flow, in accordance with examples.

FIG. 4 is a schematic diagram of a prepack screen 400, showing fines 402 passing through the prepack screen 400 during cross flow 404, in accordance with examples. As used herein, cross flow includes flow between different pressure zones of a reservoir, as well as reverse flow. During a shut-in and restart, pressure differentials between the wellbore 406 may create the cross flow 404, in which contents of the wellbore 406 can be swept into the interior 408 of the basepipe 410 through the prepack screen 400. As discussed further with respect to FIG. 5, the design of the prepack screen 400 may limit these problems, preventing larger debris fragments from plugging the prepack screen 400, or flowing into the basepipe 410.

Figure 5:
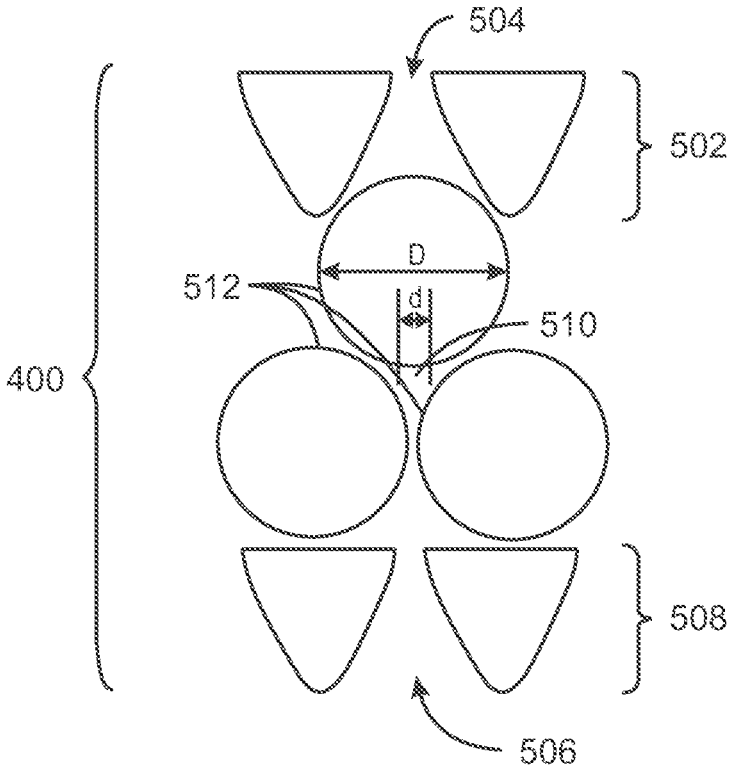
FIG. 5 is a schematic diagram of a prepack design, showing outer screen slots are designed to be comparable to slightly larger than the inner screen slots as well as the pore throats of prepack, in accordance with an example.

FIG. 5 is a schematic diagram of a design 500 for the prepack screen 400 of FIG. 4, in accordance with an example. In this example, the outer screen 502 has slots 504, or openings, that are sized to be comparable to, or slightly larger than, the slots 506, or openings, of the inner screen 508. Further, the slots 504 of the outer screen 502 are sized to be comparable to, or slightly larger than, the pore throats 510 of the prepack material 512. The size of the openings in the outer screen 502 and the inner screen 508 are termed the screen sizes, herein.

In an example, the design 500 the prepack screen 400 includes an inner screen 508 that is an 8 gauge (1 gauge=0.001 inch, 0.00254 cm) direct-wrap screen, a 14 (1400 micrometers (μm)) or 12/18 (1700/1000 μm) U.S. Mesh resin-coated proppant as the prepack material 512, and an outer screen 502 that is a 9 gauge outer wire-wrap screen. The inner screen 508 filters the injected water, similar to a standalone screen or a gravel pack screen. The prepack screen 400 is sized to not to restrict any solids passing through the inner screen 508 to avoid plugging from injected solids entrained in the injection fluid, such as water, during the injection. The design 500 decreases the chances of plugging the prepack screen 400 with the injected fluid. Other types and sizes for the prepack and screens may be used for other applications.

In some examples, the slots 504 in the outer screen 502 are also sized according to the formation size for effective sand retention. During shut-ins, some invasion of material from the formation into the prepack screen 400 is expected before a stable sand bridge is formed on the outer screen 502. A properly designed prepack screen 400 undergoes self-cleaning cycles as the flow alternates between injection and production, e.g., water hammer or cross flow. The self-cleaning cycles made clear sand caught in the slots 504, may allow sand particles to flow through the inner screen and the outer screen back to the wellbore annulus when injection is restarted, or both. Any fines that pass through the prepack screen 400 during cross flow are considered to have a low plugging risk when transported through the inner screen 508 and prepack at the low pressure interval.

Figure 6:
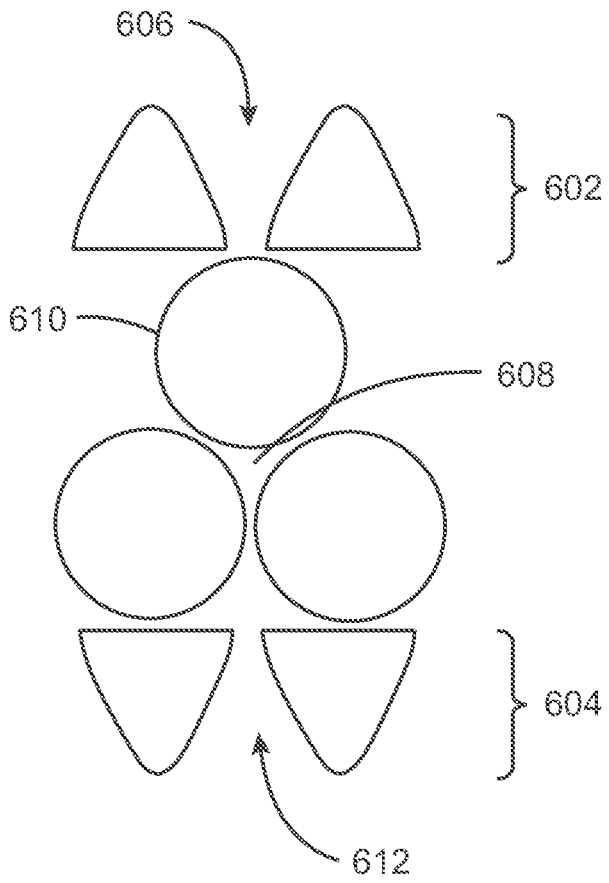
FIG. 6 a schematic diagram of a prepack design, showing inverse-keystone slots, in accordance with an example.

FIG. 6 is a schematic diagram of another design for a prepack screen 600, showing inverse-keystone slots in the outer screen 602, in accordance with an example. The outer screen 602 and the inner screen 604 may use inverse-keystone slots to favor either sand retention or sand clean-out in a certain flow directions. The relative sizes of the slots 606 of the outer screen 602, the pore throats 608 of the prepack material 610, and the slots 612 of the inner screen 604 may be sized as described with respect to the example of FIG. 5.

Figure 7:
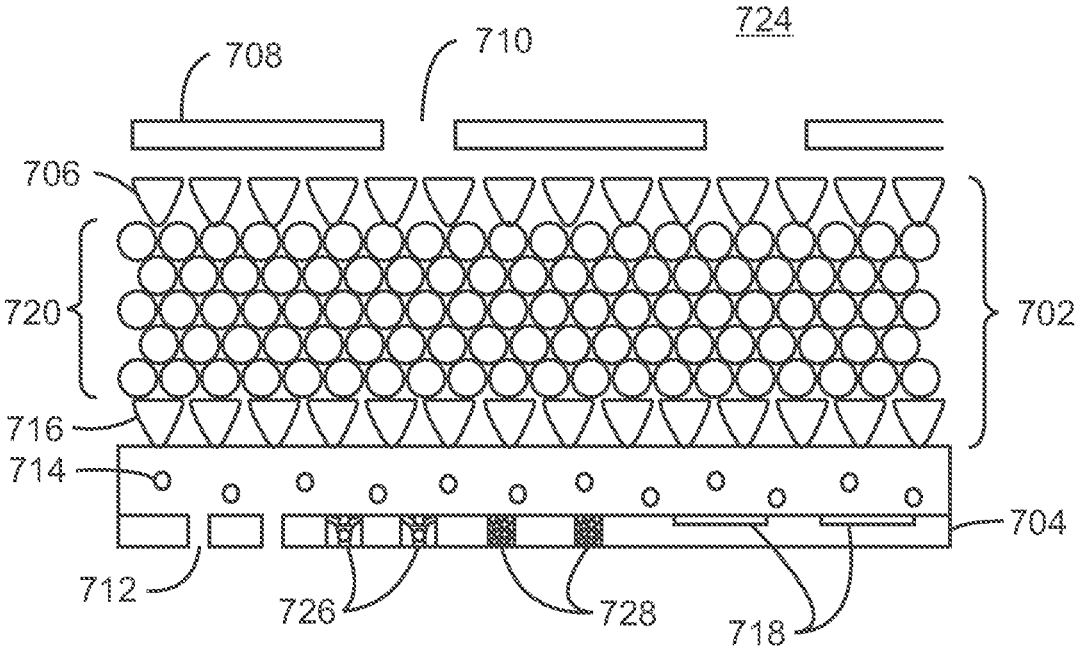
FIG. 7 is a drawing of design features in a prepack screens, in accordance with examples.

FIG. 7 is a cross-sectional view 700 of a prepack screen 702 along one side of a basepipe 704 incorporating various design features, in accordance with examples.

The multifaceted technology combination and integration expands the design domain and engineering functionality of prepack screens.

The outer screen 706 could incorporate erosion barriers 708, including, for example, shields, or rings, with openings 710 that are offset to perforations 712 on the basepipe 704 offset on the basepipe. The rib wires 714 on the between wrap wire of the inner screen 716 and the basepipe 704 could be perforated or castellated to better distribute the inflow or outflow and reduce erosion potential. The basepipe 704 may include grooves 718 to more evenly distribute the flow between the screen wrap of the inner screen 716 and the perforations 712 in the basepipe 704.

As described herein, the size of the packing material used in the prepack 720 may be selected based, at least in part, on the size of the openings of the inner screen 716 and outer screen 706. In some examples, the packing material used for the prepack 720 includes gravel particles selected from sizes ranging between about 8 U.S. mesh and about 80 U.S. mesh, for example, about 14 U.S. mesh, or another example about 20 U.S. mesh, or another example about 12 U.S. mesh to about 18 U.S. mesh. The radial thickness of packing material depends on the diameters of the inner screen 716 and the outer screen 706. In some examples, the packing material used in the prepack 720 is between about 0.25 inches (about 0.64 cm) and about 1 inch (about 2.54 cm) in thickness. In other examples the packing material used in the prepack 720 is between about 0.5 inches (about 1.3 cm) and about 0.75 inches (about 2 cm) in thickness.

The prepack 720 may be a resin-coated proppant pack cured in a factory, which allows product inspection and more consistent quality than a resin-coated gravel pack cured in downhole. In an example, the prepack 720 includes a resin-coated proppant pack formed from ceramic proppant, for example, using the FUSION® technology from CARBO Ceramics. In another example, the prepack 720 is formed from metal spheres that have been sintered to form a single structure. The metal used to form the spheres may include stainless steel, aluminum, alloy selected for downhole use, and the like. The sintering of the metal spheres into a single structure may further decrease the possibility of erosion of the prepack screen 702. In some examples, an outer screen is not used when sintered metal spheres are used as the prepack 720.

In a similar fashion to gravel pack or frac pack completions, fracturing injection is considered possible through a prepack screen 702. However, the prepack 720, is more resistant to damage, staying in the wellbore annulus 724 by being restrained between the two screens 706 and 716, and being restrained by the strength of the resin-bonding. The prepack screens described herein are installed in solid-free fluid or in a carefully-conditioned mud to minimize plugging during installation.

The prepack 720 is not limited to discrete particles, or discrete particles formed into a single resin-coated structure. In examples, the prepack 720 is a porous structure made from a shape-memory material, such as a shape-memory polymer, a shape-memory metal, or a shape-memory alloy. In this example, the prepack 720 may be cooled and compressed for installation into a wellbore, and allowed to expand as the temperature of the prepack 720 increases from the higher temperature of the wellbore. The pre-expanded shape memory material of the prepack 720 may be mounted between two screens, such as the inner screen 716 and the outer screen 706.

In some examples, the prepack 720 is a fiber network placed between the inner screen 716 and the outer screen 706.

Further, in some examples the prepack 720 is an engineered porous structure, termed a digital prepack herein, which is made from a shape memory material, a polymer, a metal, or a metal alloy by 3D printing. In one example, the prepack 720 is a structure of face-centered spheres having about 26% porosity. The structure of the face centered spheres may be printed as a contiguous unit, in which each of the spheres are in contact with and formed as part of the adjacent spheres.

In another example, a reverse printing is done with the solids matrix approximating the pore space in a face-centered sphere pack, resulting in approximately 74% porosity. In this example, the pores are connected by a constricted area rather than a point contact. The 3D printing allows a reverse-engineering design of pore connectivity and pore tortuosity in a digital prepack or porous structure to balance the structure between sand retention and sand plugging for an injection well, as discussed further with respect to FIG. 8.

In addition to the features above, the design may also include a number of combinations of check valves 726 on the basepipe, such as the Cascade[3] check valve from Tendeka. The basepipe 704 may also include prepack 728 in the perforations of basepipe, such as Bonded Bead Matrix from Baker Hughes. The check valves 726 can be combined with inflow control devices.

The prepack screen 702 can be used in combinations with various completion options, including shunt tubes for gravel or frac packing, shunted annular packers, inflow control devices or valves, self-mitigating sand screens, multiple screen compartments, or hybrid sand control systems. The concept of multiple screen compartments, for example, as described with respect to FIG. 9, can be used with check valves on the basepipe (e.g., Cascade[3] from Tendeka) or prepack in the perforations of basepipe (e.g., Bonded Bead Matrix from Baker Hughes). In some examples, multiple screen compartments may be used without a prepack, for example, having only a single layer of screen over the compartments. In these examples, the multiple screen compartments may be used with check valves on the basepipe or prepack in the perforations of basepipe, as described herein.

In some examples, the pipe joint includes a gravel reserve section near the box end and between a solid basepipe section and an outer housing. The gravel reserve section is communicated to the packing material. In low angle wells, e.g., within 60 degrees of being vertical, if the packing material volume is reduced between inner and outer screens, the upper gravel reserve will fill the gap between inner and outer screens. The reduction of packing material may be caused by change of screen openings or packing rearrangement during, e.g., installation. The gravel reserve is the same as or similar to the packing material.

Figure 8:
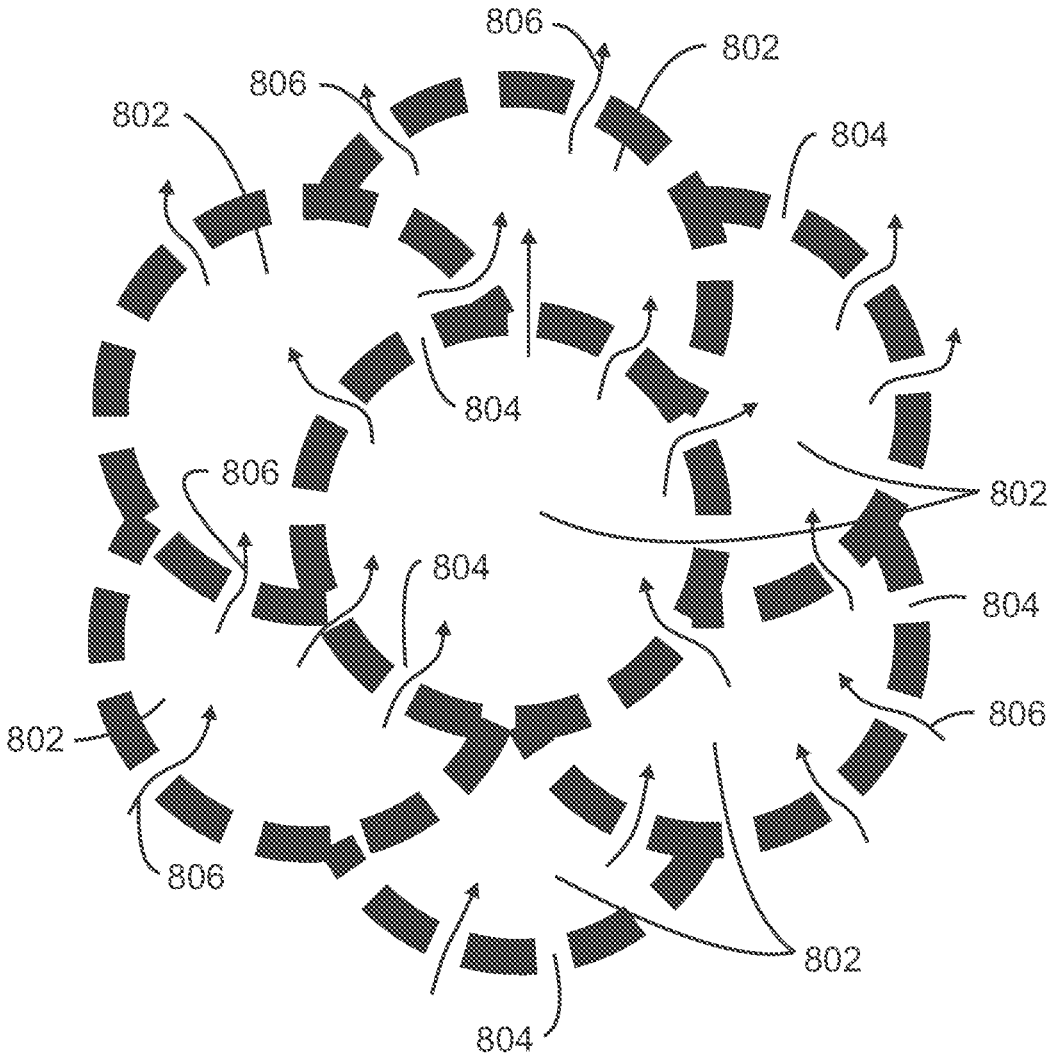
FIG. 8 is a cross-section of a 3D printing structure that may be used for prepack screens, in accordance with an example.

FIG. 8 is a cross-section of a three-dimensional printed structure 800 that may be used for prepack screens, in accordance with an example. As described herein, the 3D printed structure 800 may be formed from a shape memory material, a polymer, a metal, or other materials, such as a hydrogel.

In some examples, the shape memory material is made from a polymer, such as a shape memory foam formed from cross linked polyurethanes, which is expanded to form the final prepack. In other examples, a metal alloy, such as, Nitinol, which is an alloy of nickel and titanium, is used to form the shape memory material. The shape memory material is placed between the inner screen and outer screen, and is expanded either in factory or in downhole to full compliance, providing system integrity for water injection. In other examples, the 3D printed structure 800 used for the prepack is a rigid structure, for example, made from metal powders, such as stainless steel, aluminum, or other metals, or alloys.

As shown in FIG. 8, the 3D printed structure 800 contains a network of pore spaces 802 connected by periodic openings 804. For clarity not all of the periodic openings 804 are labeled. The periodic openings 804 include both keystone-shaped and inverse-keystone-shaped openings, such that at least one keystone-shaped opening and at least one inverse-keystone-shaped opening are along the fluid flow path in either production or injection operation. The sizes of keystone-shaped and inverse-keystone-shaped openings can be uniform or vary in the structure 800. It may be noted that the openings are not limited to keystone-openings, or inverse-keystone-openings, but may include openings that have different geometric configurations, such as cylinders, and the like.

During shut-ins, the pore spaces 802, which provide a torturous path for flow 806, provide effective formation sand retention by selective opening shapes, along with the outer screen. After the injection flow is restored, the pore spaces 802 allow effective clean-up of any trapped solids through selective opening shapes and out of the 3D printed structure 800 and the outer screen.

Figure 9A:
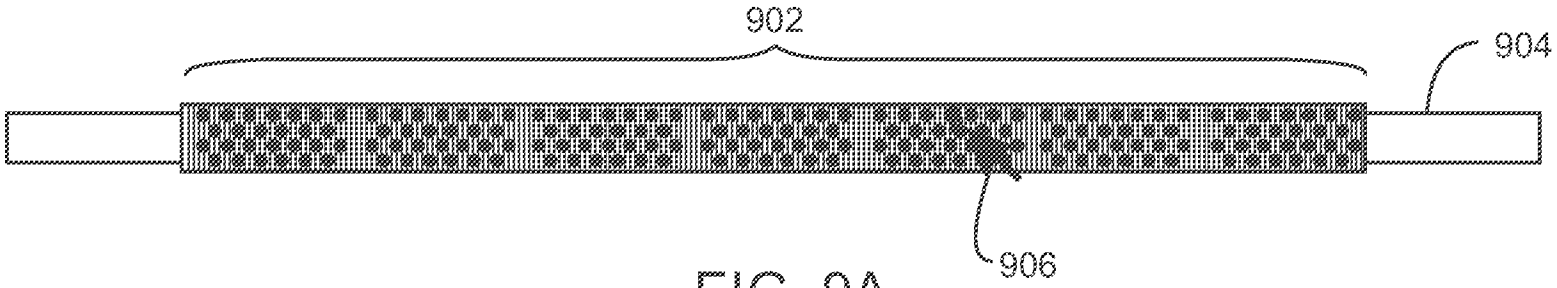
FIG. 9A is a schematic diagram of a single prepack screen assembly placed on a pipe segment, in which a single hotspot has contaminated an entire joint, in accordance with an example.

FIG. 9A is a schematic diagram of a single prepack screen assembly 902 placed on a pipe joint 904, showing a hotspot 906 on the pipe joint 904, in accordance with an example. As used herein, a pipe joint 904 is a single segment of basepipe, wherein multiple pipe joints are connected to form the basepipe, or tubing, of a well. As used herein, a hotspot is a point on a prepack screen assembly at which the prepack screen assembly has eroded, allowing material infiltration from the wellbore. The material infiltration may be limited to the prepack screen assembly, plugging off the prepack screen assembly, or may allow infiltration of material into the pipe joint itself. In this example, the single hotspot 906 has contaminated the entire pipe joint 904, or 40 foot segment, of the screen-based pipe annulus with sand. As a result, a subsequent injection may lose the entire flow interval.

Figure 9B:
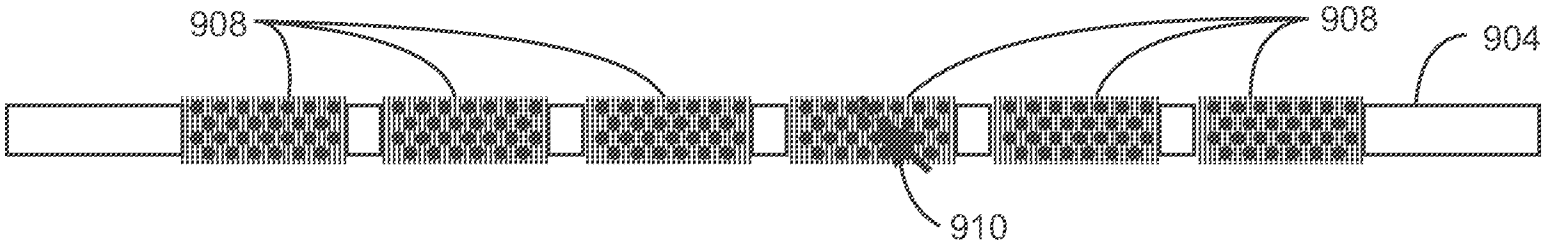
FIG. 9B is a schematic diagram of a series of compartmentalized assemblies placed on a pipe segment, in which a hotspot has developed in a single compartment, in accordance with an example.

FIG. 9B is a schematic diagram of a series of prepack screens each forming a separate compartment 908 on a pipe joint 904, in accordance with an example. In this example, each separate compartment 908 covers a limited length of the pipe joint 904, such as a segment having a length of about 3 ft (about 0.9 m), about 5.0 ft (about 1.5 m), or about 6.5 feet (about 2 m).

In FIG. 9B, a hotspot 910 has developed in a separate compartment 908. Accordingly, sand fill from the hotspot 910 may prevent water injection through the separate compartment 908 that has the hotspot 910. However, as a result of the separation between each separate compartment 908, and the use of check valves to prevent infiltration of formation material into the pipe joint 904, other separate compartments remain intact, preserving water injection.

Figure 10:
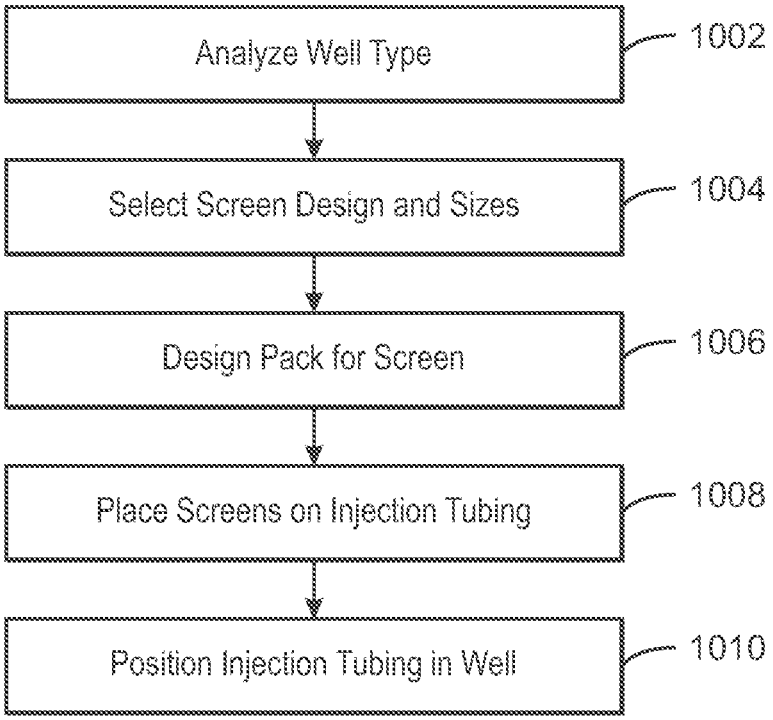
FIG. 10 is a process flow diagram of a method for designing a prepack screen, in accordance with examples.

FIG. 10 is a process flow diagram of a method for designing a prepack screen, in accordance with examples. The method begins at block 1002, with the analysis of the well type in which the screen is going to be used. For example, the screen may be used on an injection well to prevent sand contamination during shut-ins from terminating water injection. Other items that may be determined during into the analysis include, for example, the type of material in the wellbore, the friability of the material in the wellbore, the particle size of the material in the wellbore, and the number of shut-ins and restarts that may occur during the use of the well. As used herein, the friability is a measure of the tendency of the material in the reservoir to separate into smaller fragments. In one example, the friability measures the tendency of a sand reservoir to lose sand to the well annulus.

At block 1004, the screen design and sizes may be selected. For example, an inverse-keystone design may be selected to allow easier clearance of sand bridges when injection is resumed. The size of the screens may be selected to allow easy flow of expected sand particles through the screens.

At block 1006, the packing may be designed for the screen. For example, the packing size may be selected to have flow channels that are equal in size to the openings in the screens, larger in size than the openings in the screens, or smaller in size than the openings in the screens. In an example described herein, the packing is selected to have flow channels that are larger than the screen channels.

At block 1008, the screens are placed on the tubing. This may be placed in a multistep manufacturing process, for example, with a first or inner screen placed over the openings in the tubing, followed by a second or outer screen. The space between the inner screen and outer screen is then filled with the packing. In some examples, the screen assembly, including the inner screen and the outer screen, with the packing between the screens, is first manufactured, then placed over the tubing.

At block 1010, the tubing is placed in the well. In an example, the tubing is used in an injection well to protect from sand infiltration during shut-ins. This protects the injection well from the loss of flow due to sand infiltration.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions, and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements, and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A system for sand control for a well, comprising:

a reservoir; and the well drilled through the reservoir, wherein the well comprises a pipe joint comprising a prepack screen assembly mounted thereon, wherein the prepack screen assembly comprises:

an inner screen comprising openings having an inner size;

an outer screen comprising openings having an outer size; and packing material disposed between the inner screen and the outer screen comprising pores having a pore size that is selected based, at least in part, on the outer size, the inner size, or both and wherein the pore size is equal to or greater than the inner size.

2. The system of claim 1, wherein the outer size is equal to or greater than the pore size and the inner size.

3. The system of claim 1, wherein the pipe joint comprises a gravel reserve section near a box end and between a solid basepipe section and an outer housing.

4. The system of claim 1, wherein the packing material comprises a ceramic proppant.

5. The system of claim 1, wherein the packing material comprises a resin-coated proppant.

6. The system of claim 1, wherein the packing material comprises a shape-memory polymer, a shape-memory alloy, or a combination thereof.

7. The system of claim 1, wherein the packing material comprises a fiber network.

8. The system of claim 1, wherein the packing material comprises a sintered metal.

9. The system of claim 1, wherein the packing material comprises a digital prepack.

10. The system of claim 1, wherein the packing material is between about 0.64 cm to about 2.54 cm in thickness.

11. The system of claim 1, wherein the packing material comprises gravel particles having sizes ranging from about 8 U.S. mesh to about 80 U.S. mesh.

12. The system of claim 1, wherein the prepack screen assembly comprises:

the inner screen with an inner size of about 8 gauge;

the outer screen with an outer size of about 9 gauge; and the packing material comprising a resin-coated proppant pack, wherein each particle has a diameter of about 14 U.S. mesh.

13. The system of claim 1, wherein the pipe joint comprises a basepipe comprising perforations, a check valve, a bonded bead matrix, or grooves, or any combinations thereof.

14. The system of claim 1, wherein the well comprises a water injection well.

15. The system of claim 1, wherein the well comprises a gas injection well.

16. The system of claim 1, wherein the well is used as both an injection well and a production well at different points in time.

17. A method for designing a prepack screen assembly for sand control, comprising:

analyzing a type of well in which the prepack screen assembly is going to be used;

selecting a screen design and screen sizes for the prepack screen assembly, wherein screens comprise an inner screen with openings having an inner size and an outer screen with openings having an outer size;

selecting a packing for the prepack screen assembly, wherein the selected packing comprises pores comprising a pore size that is selected based, at least in part, on the outer size, the inner size, or both;

placing the prepack screen assembly on a pipe joint;

placing the pipe joint in a well; and wherein analyzing the type of well comprises determining a type of material in the well, a friability of material in the well, a particle size of the material in the well, a number of shut-ins and restarts that may occur during use of the well, or any combinations thereof.

18. The method of claim 17, wherein selecting the screen design and screen sizes comprises selecting the inner screen and the outer screen for the prepack screen assembly to allow flow of sand particles through the inner screen and the outer screen.

19. The method of claim 17, wherein designing the packing for the prepack screen assembly comprises selecting a packing size to have flow channels that are about equal in size to openings in the inner screen and the outer screen.

20. The method of claim 17, wherein designing the packing for the prepack screen assembly comprises selecting a packing size to have flow channels that are larger in size than openings in the inner screen and the outer screen.

21. The method of claim 17, comprising forming multiple prepack screen assemblies along the pipe joint wherein each prepack screen assembly comprises a separate compartment from every other prepack screen assembly.

22. The method of claim 21, wherein each separate compartment is selected to be about 1.5 m in length.

23. A prepack screen assembly, comprising:

an inner screen comprising openings having an inner size;

an outer screen comprising openings having an outer size;

packing material disposed between the inner screen and the outer screen comprising pores with a pore size that is selected based, at least in part, on the outer size, the inner size, or both; and wherein the pore size is equal to or greater than the inner size.

24. The prepack screen assembly of claim 23, wherein the outer size is equal to or greater than the pore size and the inner size.

25. The prepack screen assembly of claim 23, wherein the packing material comprises a ceramic proppant.

26. The prepack screen assembly of claim 23, wherein the packing material comprises a resin-coated proppant.

27. The prepack screen assembly of claim 23, wherein the packing material comprises a shape-memory polymer, a shape-memory alloy, or a combination thereof.

28. The prepack screen assembly of claim 23, wherein the packing material comprises a digital prepack.

29. A system for sand control for a well, comprising:

a reservoir; and the well drilled through the reservoir, wherein the well comprises a pipe joint comprising a prepack screen assembly mounted thereon, wherein the prepack screen assembly comprises:

an inner screen comprising openings having an inner size;

an outer screen comprising openings having an outer size;

packing material disposed between the inner screen and the outer screen comprising pores having a pore size that is selected based, at least in part, on the outer size, the inner size, or both; and wherein the pipe joint comprises a gravel reserve section near a box end and between a solid basepipe section and an outer housing.

30. A system for sand control for a well, comprising:

a reservoir; and the well drilled through the reservoir, wherein the well comprises a pipe joint comprising a prepack screen assembly mounted thereon, wherein the prepack screen assembly comprises:

an inner screen comprising openings having an inner size;

an outer screen comprising openings having an outer size;

packing material disposed between the inner screen and the outer screen comprising pores having a pore size that is selected based, at least in part, on the outer size, the inner size, or both; and wherein the packing material comprises a fiber network.

31. A method for designing a prepack screen assembly for sand control, comprising:

analyzing a type of well in which the prepack screen assembly is going to be used;

selecting a screen design and screen sizes for the prepack screen assembly, wherein screens comprise an inner screen with openings having an inner size and an outer screen with openings having an outer size;

selecting a packing for the prepack screen assembly, wherein the selected packing comprises pores comprising a pore size that is selected based, at least in part, on the outer size, the inner size, or both;

placing the prepack screen assembly on a pipe joint; and placing the pipe joint in a well; and wherein selecting the screen design and screen sizes comprises selecting the inner screen and the outer screen for the prepack screen assembly to allow flow of sand particles through the inner screen and the outer screen.

32. A method for designing a prepack screen assembly for sand control, comprising:

analyzing a type of well in which the prepack screen assembly is going to be used;

selecting a screen design and screen sizes for the prepack screen assembly, wherein screens comprise an inner screen with openings having an inner size and an outer screen with openings having an outer size;

selecting a packing for the prepack screen assembly, wherein the selected packing comprises pores comprising a pore size that is selected based, at least in part, on the outer size, the inner size, or both;

placing the prepack screen assembly on a pipe joint; and placing the pipe joint in a well; and wherein designing the packing for the prepack screen assembly comprises selecting a packing size to have flow channels that are about equal in size to openings in the inner screen and the outer screen.

33. A method for designing a prepack screen assembly for sand control, comprising:

analyzing a type of well in which the prepack screen assembly is going to be used;

selecting a screen design and screen sizes for the prepack screen assembly, wherein screens comprise an inner screen with openings having an inner size and an outer screen with openings having an outer size;

selecting a packing for the prepack screen assembly, wherein the selected packing comprises pores comprising a pore size that is selected based, at least in part, on the outer size, the inner size, or both;

placing the prepack screen assembly on a pipe joint; and placing the pipe joint in a well; and wherein designing the packing for the prepack screen assembly comprises selecting a packing size to have flow channels that are larger in size than openings in the inner screen and the outer screen.

34. A method for designing a prepack screen assembly for sand control, comprising:

analyzing a type of well in which the prepack screen assembly is going to be used;

selecting a screen design and screen sizes for the prepack screen assembly, wherein screens comprise an inner screen with openings having an inner size and an outer screen with openings having an outer size;

selecting a packing for the prepack screen assembly, wherein the selected packing comprises pores comprising a pore size that is selected based, at least in part, on the outer size, the inner size, or both;

placing the prepack screen assembly on a pipe joint;

forming multiple prepack screen assemblies along the pipe joint wherein each prepack screen assembly comprises a separate compartment from every other prepack screen assembly; and placing the pipe joint in a well.

* * * * *